United States Patent [19]

Coates

[11] Patent Number: 4,944,261

[45] Date of Patent: Jul. 31, 1990

[54] SPHERICAL ROTARY VALVE ASSEMBLY FOR AN INTERNAL COMBUSTION ENGINE

[76] Inventor: George J. Coates, 2500 Belmar Blvd., Wall Township, Monmouth County, N.J. 07719

[21] Appl. No.: 422,053

[22] Filed: Oct. 16, 1989

[51] Int. Cl.[5] ..... F01L 7/10

[52] U.S. Cl. ..... 123/190 D; 123/190 A; 123/190 E

[58] Field of Search ..... 123/190 A, 190 D, 190 E, 123/190 DL

[56] References Cited

U.S. PATENT DOCUMENTS

| | | | |
|---|---|---|---|
| 4,077,382 | 3/1978 | Gentile | 123/190 A |
| 4,545,337 | 10/1985 | Lyons et al. | 123/190 A |
| 4,821,692 | 4/1989 | Browne | 123/190 A |

*Primary Examiner*—E. Rollins Cross
*Attorney, Agent, or Firm*—Clifford G. Frayne

[57] ABSTRACT

An improved rotary valve assembly for use in internal combustion engines involving a two-piece cylinder head accommodating rotary intake valves and rotary exhaust valves mounted on independent shafts, operating at one-quarter speed of the crankshaft rotation with each of the rotary intake valves and rotary exhaust valves having two passageways for the introduction and interruption of fuel/air mixture into the cylinder and the evacuation and interruption of evacuation of the spent gases from the cylinder, respectively, the lubrication of the rotary valve assembly being by a drip feed through a longitudinal conduit in each respective shaft and radial conduits in each respective shaft in registration with the bearing means supporting the shaft within the cylinder head.

18 Claims, 7 Drawing Sheets

SPHERICAL ROTARY VALVE ASSEMBLY FOR AN INTERNAL COMBUSTION ENGINE

FIELD OF INVENTION

This invention relates to an internal combustion engine of the piston and cylinder type and, more particularly, to a spherical rotary valve assembly for the introduction of the fuel and air mixture to the cylinder and the evacuation of exhaust gases. The improvement is directed to multi-port rotary spherical valves and an independent drip feed lubrication for the valve shaft.

BACKGROUND OF THE INVENTION

In an internal combustion engine of a piston and cylinder type, it is necessary to charge the cylinder with a fuel and air mixture for the combustion cycle and to vent or evacuate the exhaust gases at the exhaust cycle of each cylinder of the engine. In the conventional piston and cylinder type engine, these events occur thousands of times per minute per cylinder. In the conventional internal combustion engine, the rotation of a camshaft causes a spring-loaded valve to open to enable the fuel and air mixture to flow from the carburetor to the cylinder and the combustion chamber during the induction stroke. This camshaft closes this intake valve during the compression and combustion stroke of the cylinder and the same camshaft opens another spring-loaded valve, the exhaust valve, in order to evacuate the cylinder after compression and combustion have occurred. These exhaust gases exit the cylinder and enter the exhaust manifold.

The hardware associated with the efficient operation of conventional internal combustion engines having spring-loaded valves includes items such as springs, cotters, guides, rockers shafts and the valves themselves which are usually positioned in the cylinder heads such that they normally operate in a substantially vertical position, with their opening, descending into the cylinder for the introduction or venting or evacuation of gases.

As the revolutions of the engine increase, the valves open and close more frequently and the timing and tolerances become critical in order to prevent the inadvertent contact of the piston with an open valve which can cause serious engine damage. With respect to the aforementioned hardware and operation, it is normal practice for each cylinder to have one exhaust valve and one intake valve with the associated hardware mentioned heretofore; however, many internal combustion engines have now progressed to multiple valve systems, each having the associated hardware and multiple camshafts.

In the standard internal combustion engine, the camshaft is rotated by the crankshaft by means of a timing belt or chain. The operation of this camshaft and the associated valves operated by the camshaft presents the opportunity to decrease the engine efficiency to the friction associated with the operation of the various elements. Applicant's invention is directed towards a novel valve means which eliminates the need for spring-loaded valves and the associated hardware and in its simplest explanation, enlarges the camshaft to provide for spherical rotary valves to feed each cylinder. This decreases the number of moving parts and hence the friction involved in the operation of the engine and increases engine efficiency. It also eliminates the possibility of the piston contacting an open valve and thus causing serious engine damage.

Applicant's invention is applicable to utilization of a single shaft containing a spherical rotary intake valve and a spherical rotary exhaust valve per cylinder. Applicant's pending applications, Ser. Nos. 270,027 and 409,037 are directed to a design in which the valve mechanism operates at one-half the crankshaft speed. Applicant's present disclosure is applicable to a multiple shaft arrangement wherein the spherical rotary intake valves are mounted on a first shaft and the spherical rotary exhaust valves are mounted on a second shaft, the shafts being in substantial parallel alignment and geared between the crankshaft and each valve shaft to provide for normal half speed rotation with the crankshaft or quarter speed rotation with the crankshaft or one-eighth speed rotation with the crankshaft depending upon the porting of the rotary spherical valves. The lubrication of this system is accomplished by a drip feed to the spherical rotary valve bearings through the support shaft.

OBJECT OF THE INVENTION

An object of the present invention is to provide for a novel and unique valve mechanism for internal combustion engines which eliminates the need for spring-loaded valves.

Another object of the present invention is to provide a novel and unique valve mechanism for internal combustion engines which increases the efficiency of the engine.

Another object of the present invention is to provide a novel and unique valve mechanism for internal combustion engines which decreases the friction generated by an internal combustion engine and increases the efficiency of the engine.

A still further object of the present invention is to provide for a novel and unique valve mechanism for an internal combustion engine which has fewer moving parts and thus permits the engine to operate at higher revolutions per minutes.

A still further object of the present invention is to provide for a novel and unique valve mechanism for internal combustion engines which operates at substantially lower revolutions per minute than the crankshaft.

A still further object of the present invention is to provide for a novel and unique valve mechanism for an internal combustion engine which can be utilized with internal combustion engines which are fuel-injected or carbureted.

A still further object of the present invention is to provide for a novel and unique valve mechanism for internal combustion engines which does not require pressurized lubrication.

A still further object of the present invention is to provide for a novel and unique valve mechanism for internal combustion engines in which the valve mechanism is multi-shafted and the intake valves and exhaust valves are segregated.

SUMMARY OF THE INVENTION

An improved rotary valve assembly for use in internal combustion engines involving a two-piece cylinder head accommodating rotary intake valves and rotary exhaust valves mounted on independnet shafts, operating at one-quarter speed of the crankshaft rotation with each of the rotary intake valves and rotary exhaust valves having two passageways for the introduction and interruption of fuel/air mixture into the cylinder and the evacuation and interruption of evacuation of the spent gases from the cylinder, respectively, the lubrication of the rotary valve assembly being by a drip feed through a longitudinal conduit in each respective shaft and radial conduits in each respective shaft in registration with the bearing means supporting the shaft within the cylinder head.

BRIEF DESCRIPTION OF THE DRAWINGS

These and other advantages and improvements will be evident especially when taken with the following drawings wherein.

DETAILED DESCRIPTION OF THE DRAWINGS

Figure 1:
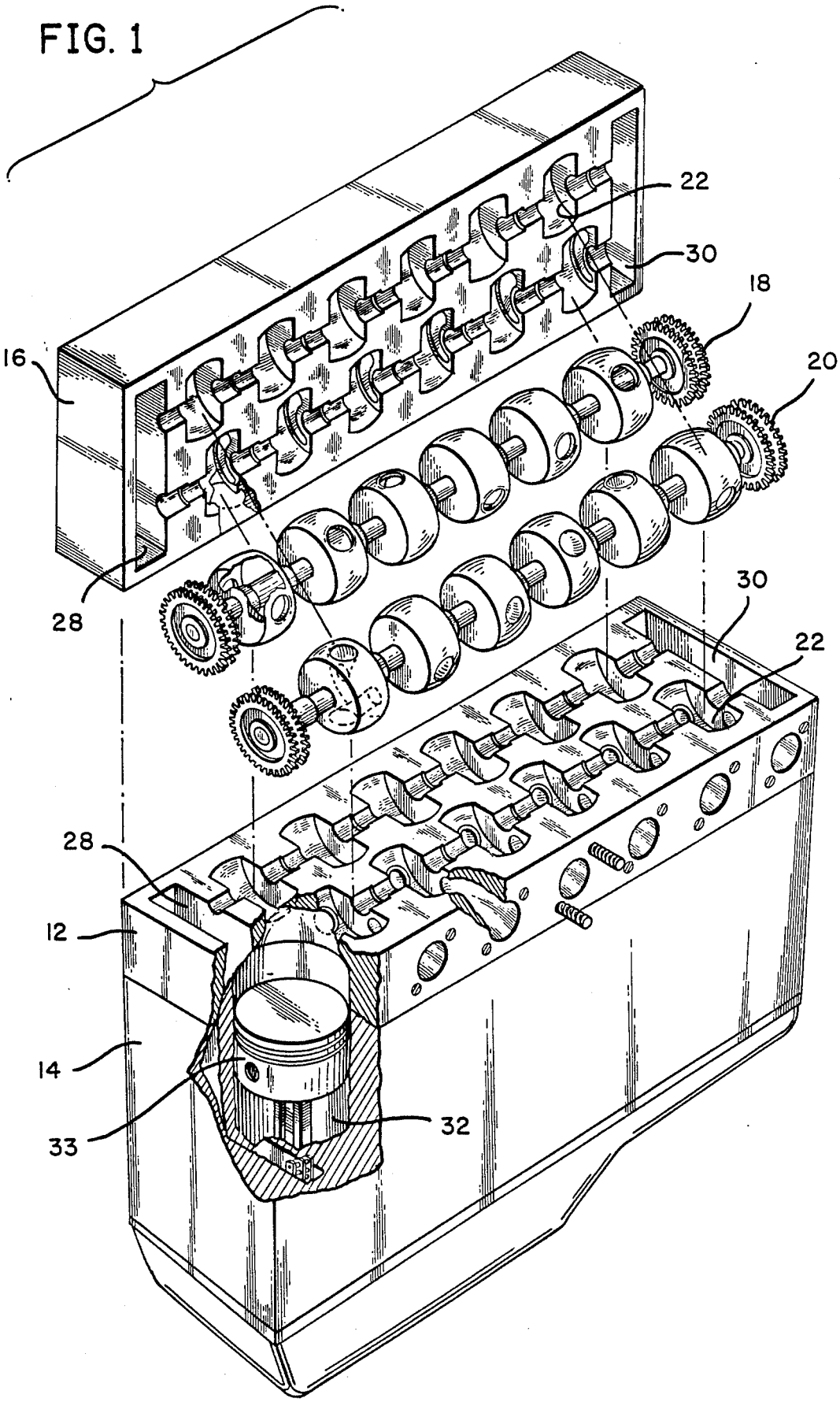
FIG. 1 is an exploded view of the improved spherical rotary valve assembly.

Referring to FIG. 1, there is shown an exploded view of the spherical rotary valve assembly The assembly comprises a split head comprising a lower section 12 secured to engine block 14 and an upper split head section 16 which is secured to lower split head section 12. Split head assembly sections 12 and 16 are designed to accommodate an intake spherical rotary valve assembly 18 and an exhaust spherical rotary valve assembly 20 in drum accommodating cavities 22. As can best be seen if FIG. 1, lower split head assembly 12 contains one-half of the drum accommodating cavities 22 for the intake spherical valve assembly 18 and exhaust spherical valve assembly 20 and upper split head assembly 16 contains the other half of drum accommodating cavities 22 for the respective intake spherical valve assembly 18 and exhaust spherical valve assembly 20 such that when lower split head section 12 and upper split head section 16 are secured, the intake spherical drum assembly 18 and exhaust spherical drum assembly 20 are positioned such that the intake spherical valves 24 and the exhaust spherical valves 26 are enclosed in the respective drum accommodating cavities 22.

Additionally, the longitudinal ends of lower split head assembly 12 and upper split head assembly 16 contain cavities 28 and 30 for accommodation of the gearing mechanism for intake spherical drum assembly 18 and exhaust spherical drum assembly 20 as described hereafter. Cylinder 32 and piston 23 contained within cylinder 34 are positioned in engine block 14.

Figure 2:
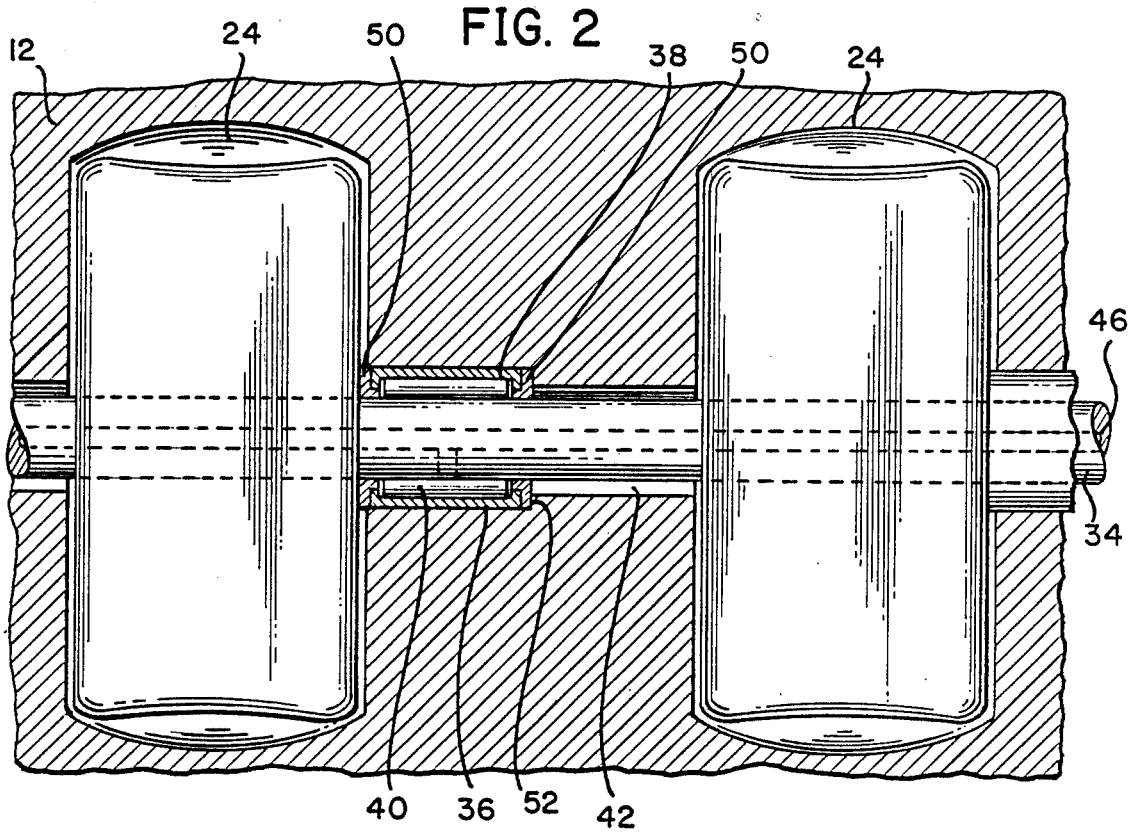
FIG. 2 is a top, planer partial cutaway view, of the intake valve and shaft assembly.

Referring to FIG. 2, there is shown a top planer partially cutaway view of intake spherical drum assembly 18 positioned in lower split head section 12. There is one spherical intake valve 24 associated with each cylinder 32 in engine block 14. Intake spherical valves 24 are mounted on shaft means 34 with a bearing positioned on shaft 34 between adjacent spherical intake valves 24. The bearing means 36 comprises a cylindrical bearing housing 38 having circumferentially disposed therein, a plurality of needle roller bearings 40, in contact with shaft 34 which will rotate on needle roller bearings 40. Bearing means 36 is positioned between drum accommodating cavities 22 and lower split head section 12 and upper split head section 16 in cylindrical cavities 42 which extend between adjacent drum accommodating cavities 22.

Figure 3:
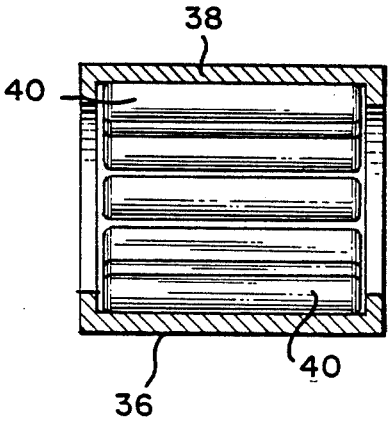
FIG. 3 is a side, cutaway view of the bearing means for the spherical rotary valve assembly.
Figure 4:
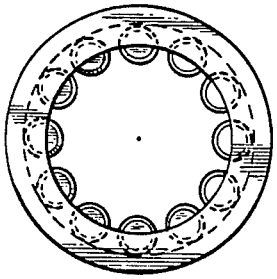
FIG. 4 is an end view.
Figure 5:
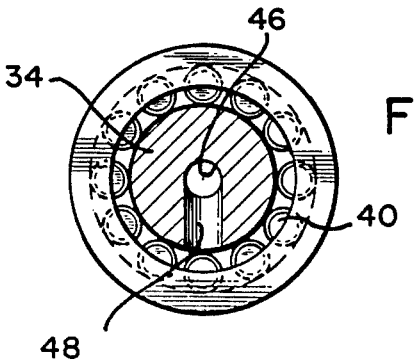
FIG. 5 is an end view of the bearing means mounted on the shaft for the rotary valve assembly.

Intake spherical rotary valves 24 are secured to shaft 34 so as to rotate with shaft 34. FIGS. 3, 4 and 5 are a side cross sectional, end view and end view on shaft 34 respectively of bearing means 36. Shaft 34 has defined through its longitudinal axis, a conduit 46 for the lubrication of bearing means 36. In this configuration, the oil sump pump provides oil to conduit 46 at one longitudinal end of shaft 34. The oil passes through conduit 46 which has appropriately placed transverse conduits 48 positioned to coincide with bearing means 36 thus directing oil from conduit 46 through transverse conduit arm 48 to needle roller bearing surface 40. Excess oil passes through longitudinal conduit is provided to needle roller bearings 40 through a drip process supplying oil as needed to needle roller bearings 40. Oil is thus segregated from the intake spherical rotary valve and exhaust spherical rotary valve which do not require the lubrication as a result of the sealing mechanism described hereafter. A pair of seals 50 are positioned at each end of bearing means 36, one such seal 50 will be in proximate contact with either an exhaust spherical drum 26 or intake spherical drum 24, respectively and the other seal contacting a recess lip 52 thus maintaining the seal in position.

Figure 6:
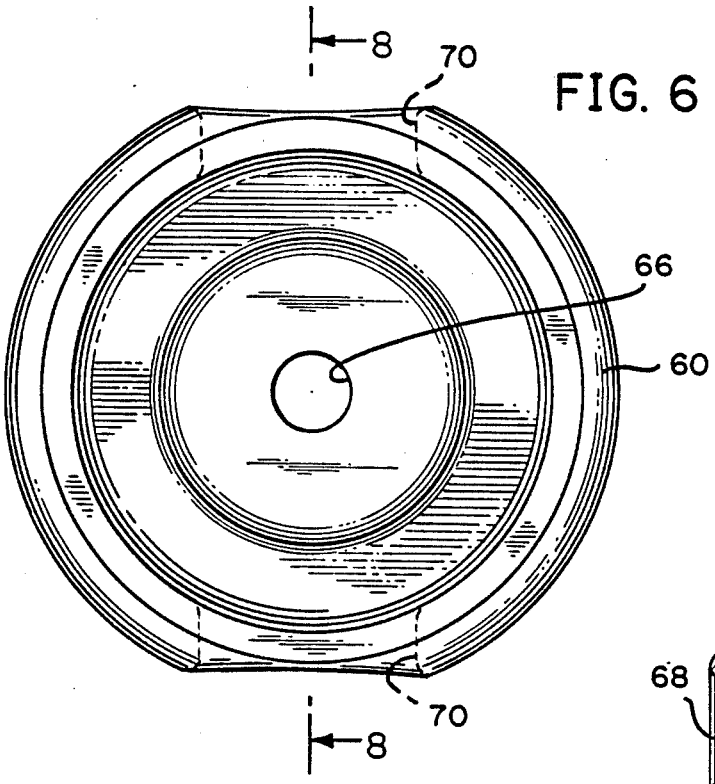
FIG. 6 is a front view of a spherical intake valve.
Figure 7:
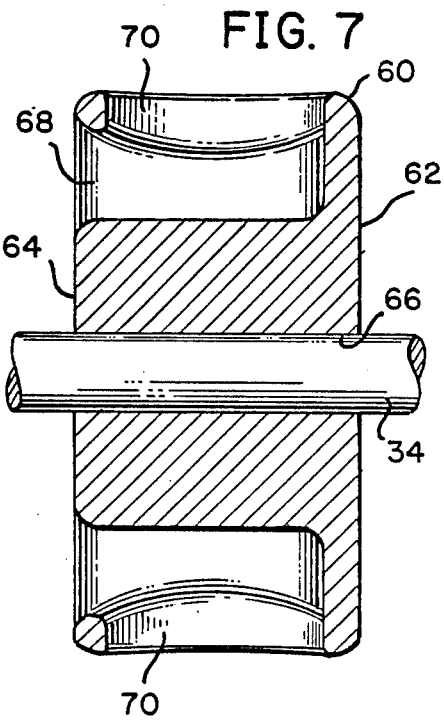
FIG. 7 is a side cutaway view along plane 8—8 of FIG. 7 of a spherical intake valve.
Figure 8:
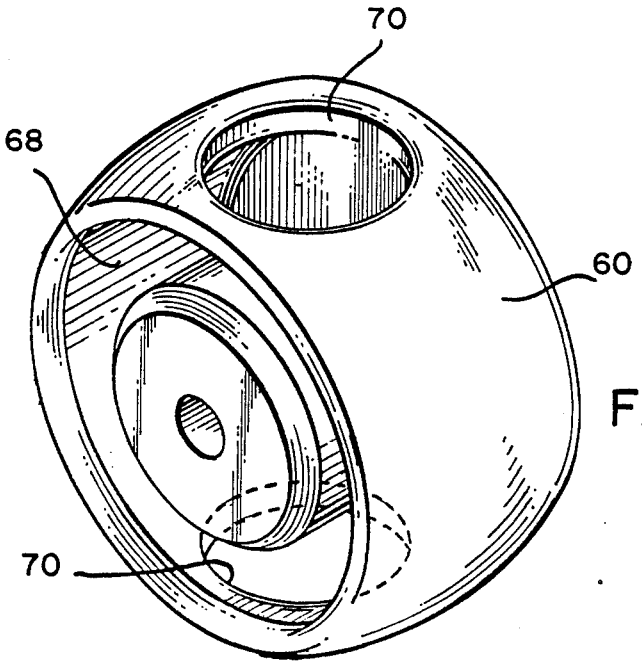
FIG. 8 is a perspective view of a spherical intake valve.

Referring to FIG. 6, there is shown a front view of intake spherical valve 24, FIG. 7 is side cutaway view of intake spherical valve 24 along plane 8—8 of FIG. 7 and FIG. 8 represents a perspective view of intake spherical valve 24. Intake spherical valve 24 is defined by an arcuate spherical circumferential periphery 60 and planer sidewalls 62 and 64. Intake spherical valve 24 has centrally disposed aperture 66 for mounting intake the spherical valve 24 on shaft 34 of intake spherical valve assembly 18. The centrally disposed aperture 66 can be of a splined configuration to interlock with a splined configuration on shaft 34 or may be mounted by other conventional means. It will be recognized by those skilled in the art, however, that the mounting method for intake spherical valve 24 may vary and may in fact utilize a locking key type mechanism to secure intake spherical valve 24 to shaft 34.

Disposed inwardly from planer sidewall 64 is a annular U-shaped or doughnut cavity 68 which extends from planer sidewall 64 to a depth approximate to planer sidewall 62.

Positioned on spherical circumferential periphery 60 of intake spherical valve 24 are two apertures 70 positioned 180° apart, aperture 70, providing a passageway from spherical circumferential periphery 60 to annular U-shaped or doughnut cavity 68. In this configuration, intake spherical valve 24 is shown with two apertures 70 on circumferential periphery 60 is designed to provide for the intake spherical valve 24 to operate at ¼ speed of that of the engine crankshaft. A single aperture 70 on intake spherical valve 24 would allow the intake spherical drum 24 to operate at ½ the speed of the engine crankshaft under proper gear ratioing as described hereafter. Aperture 70 on spherical circumferential periphery 60 of intake spherical valve 24 are designed to be placed in sequential rotary alignment with the inlet port to the cylinder as described hereafter in order to provide a fuel/air charge to the cylinder.

It should be noted that planer sidewall 62 of intake spherical valve 24 would be in contact with seal 50 of bearing means 36 which would be positioned on shaft 34 immediately adjacent intake spherical valve 24. Such bearing means 34 would be positioned immediately adjacent planer sidewall 62 of each of intake spherical valves 24 along shaft 34 as shown in FIG. 1.

Figure 9:
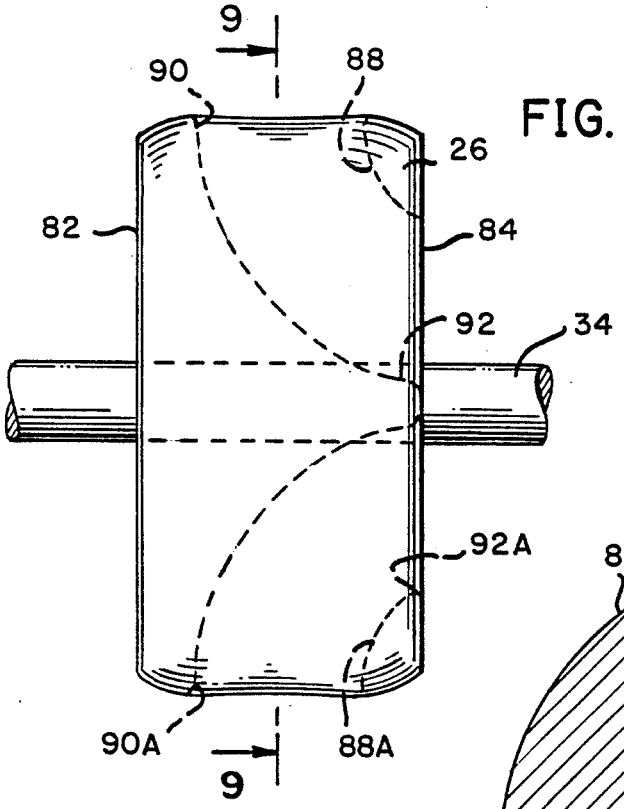
FIG. 9 is a side elevational view of a spherical exhaust valve.
Figure 10:
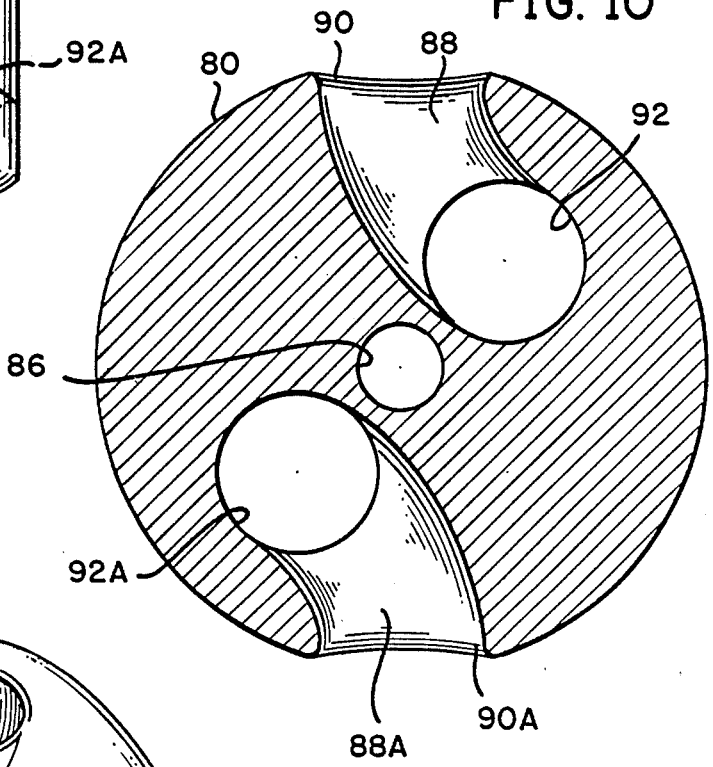
FIG. 10 is a front cutaway view of a spherical exhaust valve along plane 9—9 of FIG. 9.
Figure 11:
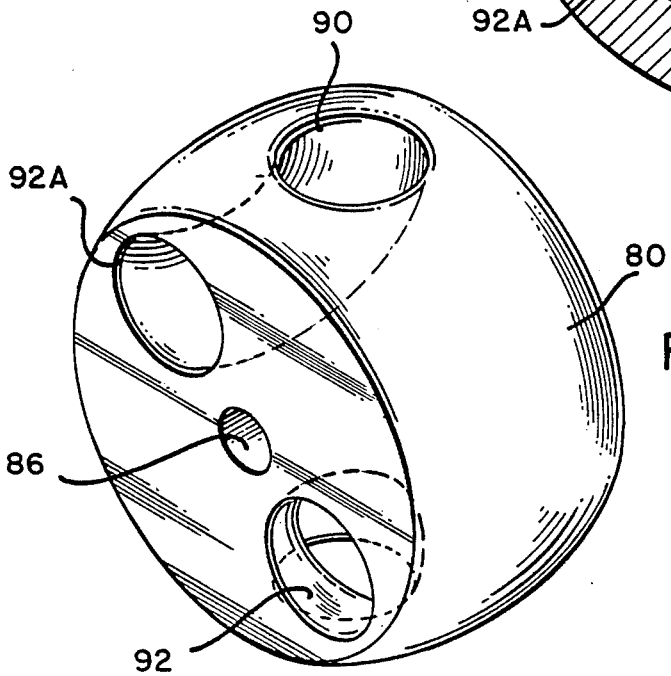
FIG. 11 is a perspective view of a spherical exhaust valve.

Referring to FIGS. 9, 10 and 11, there is shown a side elevational view of exhaust spherical valve 26, a front cutaway view of exhaust spherical valve 26 and a perspective view of exhaust spherical valve 26, respectively. Exhaust spherical valve 26 has an arcuate spherical circumferential periphery 80 having intersecting planer sidewalls 82 and 84. Centrally-disposed through exhaust spherical valve 26 is an aperture 86 for the mounting of exhaust spherical valve 26 on shaft 34. Again, aperture 86 may be of a splined configuration, however, other configurations would be acceptable in order to ensure that exhaust spherical valve 26 would rotate with shaft 34.

Exhaust spherical valve 26 has defined therethrough, two exhaust conduits 88 and 88A. Exhaust conduit 88 and 88A are defined by an aperture 90 and 90A on the spherical periphery 80 of exhaust spherical valve 26. Second apertures 92 and 92A are positioned on planer sidewall 84 of exhaust spherical valve 26. Apertures 90 and 90a are designed to come into sequential rotary alignment with the exhaust port of the cylinder for the evacuation of exhaust gases. As such, apertues 90 and 90A are positioned approximately 180° apart on exhaust spherical valve 26 in order that exhaust spherical valve 26 can rotate at ¼ the speed of the engine crankshaft under the gearing ratios described hereafter.

Figure 12:
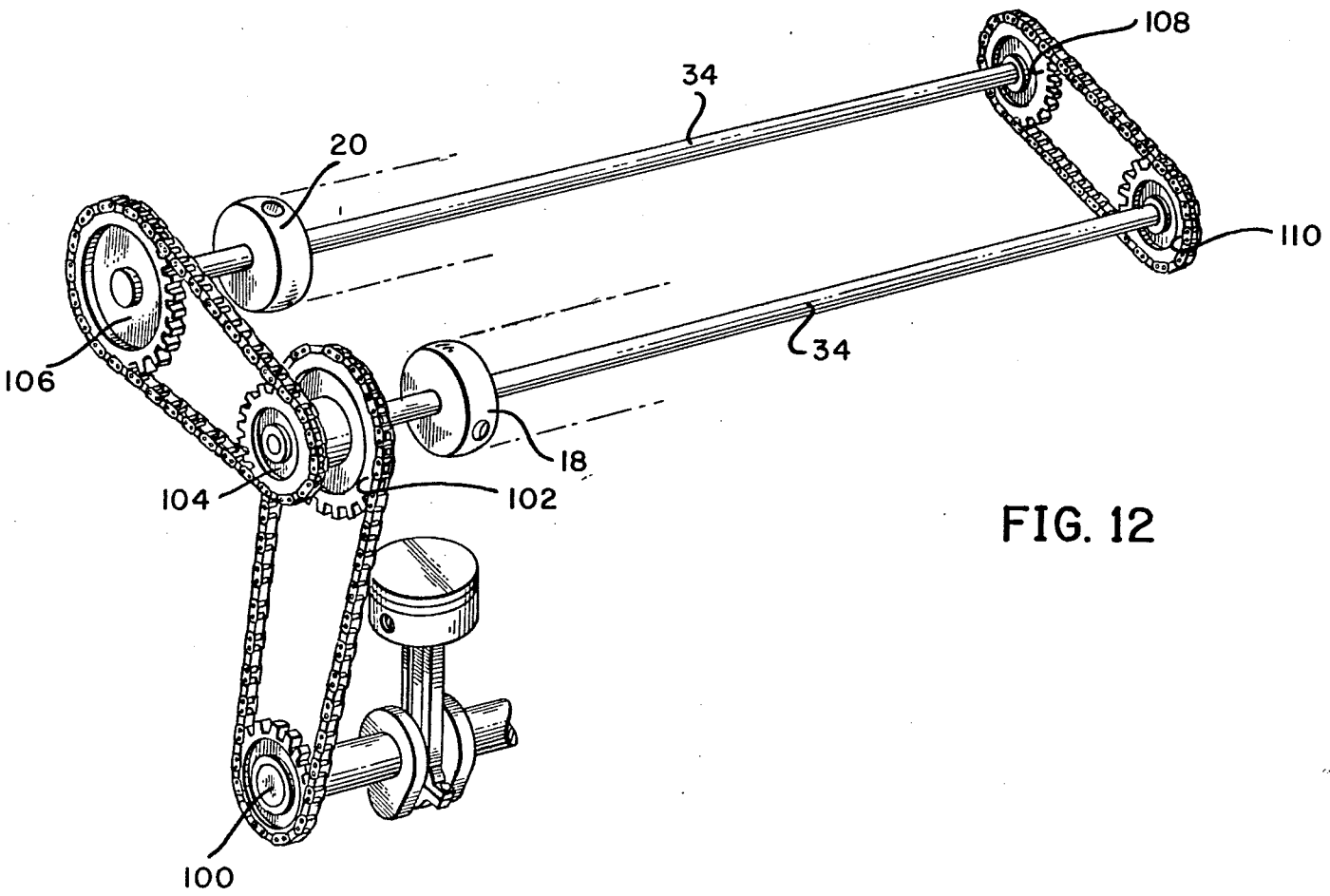
FIG. 12 is a schematic cutaway view of the gear mechanism for the spherical rotary valve assembly.

Referring to FIG. 12, there is shown a schematic of the drive and gear mechanism for the spherical rotary valve assembly in operation at ¼ speed in relationship to the crank-shaft. The crankshaft driving gear 100 would be in communication by belt drive or chain drive with idler gear 102. Idler gear 102 is mounted on intake spherical valve assembly 18 and, in particular, on shaft 34 which supports intake spherical valves 24. However, idler gear 102 does not drive or rotate shaft 34. Idler gear 102 is in communication with drive gear 104 mounted on the same longitudinal end of shaft 34 of intake spherical valve assembly 18. Gear 104 is in communication with drive gear 106 mounted on shaft 34 of exhaust spherical valve assembly 20. Drive gear 106 is secured to shaft 34 of the exhaust spherical valve assembly 20 and drives shaft 34 or rotates shaft 34 causing the exhaust spherical valves to rotate. Mounted on the opposite longitudinal end of shaft 34 of exhaust spherical drive assembly 20 is drive gear 108 which is in communication with an identical drive gear 110 mounted on the opposite longitudinal end of intake spherical drive assembly 18. Drive gear 108 communicates with drive gear 110 and causes shaft 34 of the intake spherical valve assembly 18 to rotate thus driving or rotating the intake spherical valves 24.

The drive assembly thus follows the following path, crankshaft gear 100 communicates with idler gear 102 which drives drive gear 104 which in turn drives gear 106 rotating shaft 34 of the exhaust rotary valve assembly, gear 108 of the exhaust spherical valve assembly driving gear 110 on the intake spherical valve assembly 18 causing shaft 34 of the intake spherical valve assembly to rotate thus causing the rotation of the intake spherical valves 24.

The gearing ratio for this quarter speed assembly is as follows: drive gear 100 to idler gear 102, 1:2; idler gear 102 to drive gear 104, 2:1; drive gear 104 to drive gear 106, 1:2 and drive gear 108 to drive gear 110, 1:1.

In this quarter speed embodiment, the intake spherical valves 24 would have two apertures on the spherical periphery of the valve for registration with the inlet port to the cylinder. The exhaust spherical valve 26 would have two passageways therethrough, each having an aperture on the periphery of the exhaust spherical valve 26 for registration with the outlet port of the cylinder for the evacuation of gases.

Figure 13:
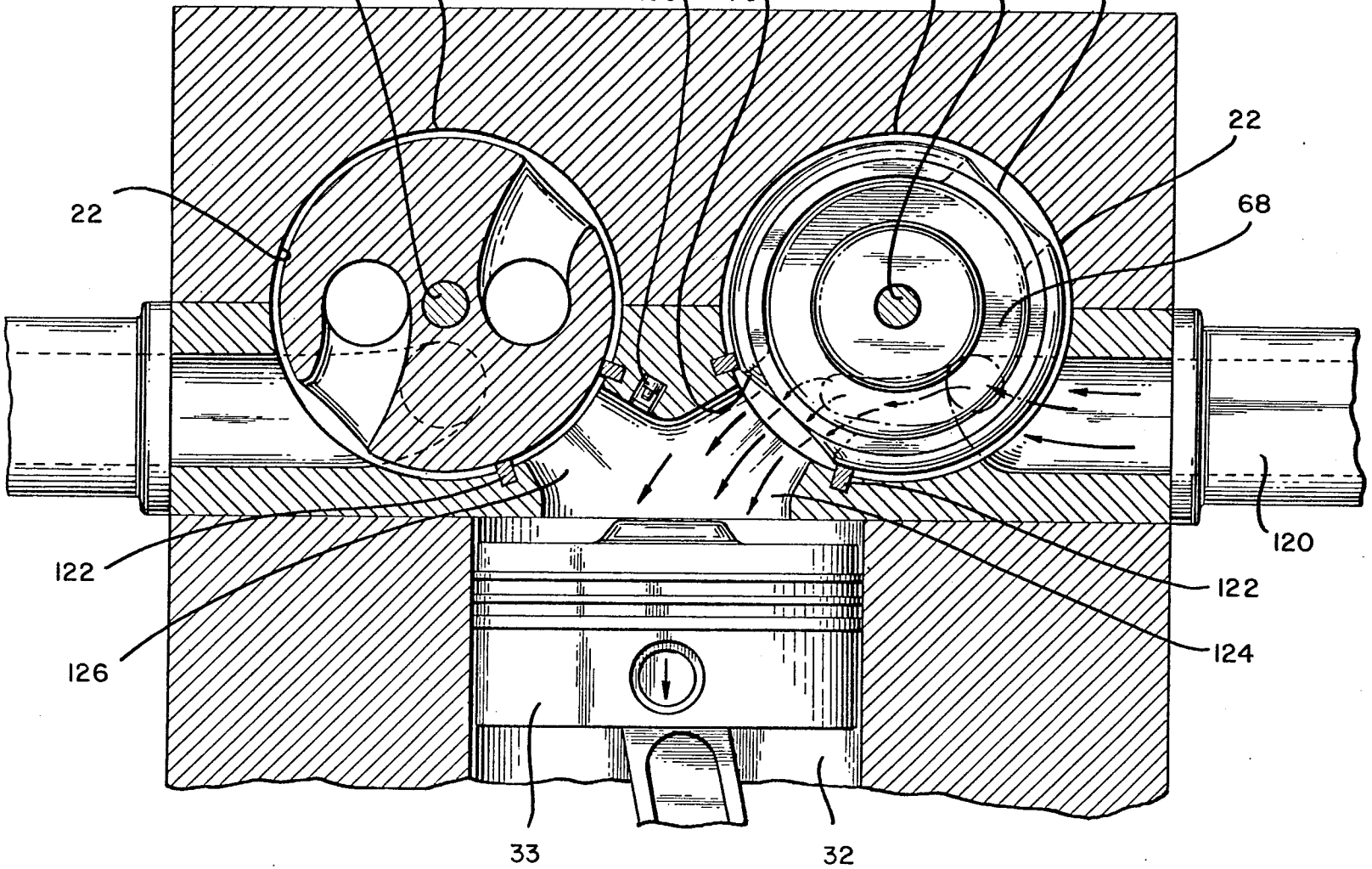
FIG. 13 is a cross sectional end view of the spherical valve assembly showing the relationship between the spherical intake valve and the spherical exhaust valve during the introduction of the fuel/air mixture.

FIG. 13 is an end view of the rotary valve assembly showing the relationship of the intake spherical valve 24 and exhaust spherical valve 26 during the introduction of the fuel/air mixture into cylinder 32. Intake spherical valve 24 and exhaust spherical valve 26 are shown positioned in drum accommodating cavities 22 mounted on shafts 34. Doughnut or U-shaped cavity 68 in intake spherical valve 24 is in communication with the engine inlet port 120 which introduces fuel/air mixture into U-shaped or doughnut cavity 68 continuously. The fuel/air mixture would be mixed prior to introduction by means of a carburetor or the positioning of a fuel injector means immediately before intake spherical valve 24. In this configuration, U-shaped or doughnut cavity 68 is continually charged with a fuel/air mixture. In FIG. 13, engine inlet port 120 is shown as being positioned in the lower portion of the split head assembly. The positioning of engine inlet port 120 is a matter of choice depending upon the manner in which the fuel/air mixture is mixed, i.e., carburetor or fuel injection. The engine inlet port 120 could be positioned in the upper portion of split head assembly wihout departing from the spirit of the invention. As can be seen in FIG. 13, intake spherical valve 24 rotates about shaft 34 within drum accommodating cavities 22 and contacts a sealing ring 122 positioned annularly circumferentially about cylinder inlet port 124.

Exhaust spherical valve 26 is similarly mounted on a shaft 34 in contact with a sealing ring means 124 which is circumferentially positioned about cylinder exhaust port 126. As shown in FIG. 13, exhaust spherical valve 26 is in a closed position with exhaust port 126 sealed by the outer periphery 80 of exhaust spherical valve 26. Intake spherical valve 24 is in the open position with one of its two peripherally located apertures 70 in registration with inlet port 124 to cylinder 32. The fuel/air mixture is therefore being introduced into cylinder 32 by means of engine inlet port 120 into the split head, and the doughnut or U-shaped cavity 68 within intake spherical valve 24 and peripheral aperture 70 on intake spherical valve 24. Cylinder 32 would be charged with a fuel/air mixture during aperture 70's registration with inlet port 124. Piston 33 would be at its lowermost position within cylinder 32 when the cylinder was fully charged. At that point in time, aperture 70 on intake spherical valve 24 would have moved out of registration with inlet port 124 thus sealing inlet port 124. While inlet port 124 and outlet port 126 were respectively sealed, piston 33 would begin its upward movement compressing the fuel/air mixture and ignition would occur by means of spark plug 130 positioned in the exhaust port 126. Piston 33 would be driven downwardly within cylinder 32 and then commence an upward stroke for the evacuation of the exhaust gases.

Figure 14:
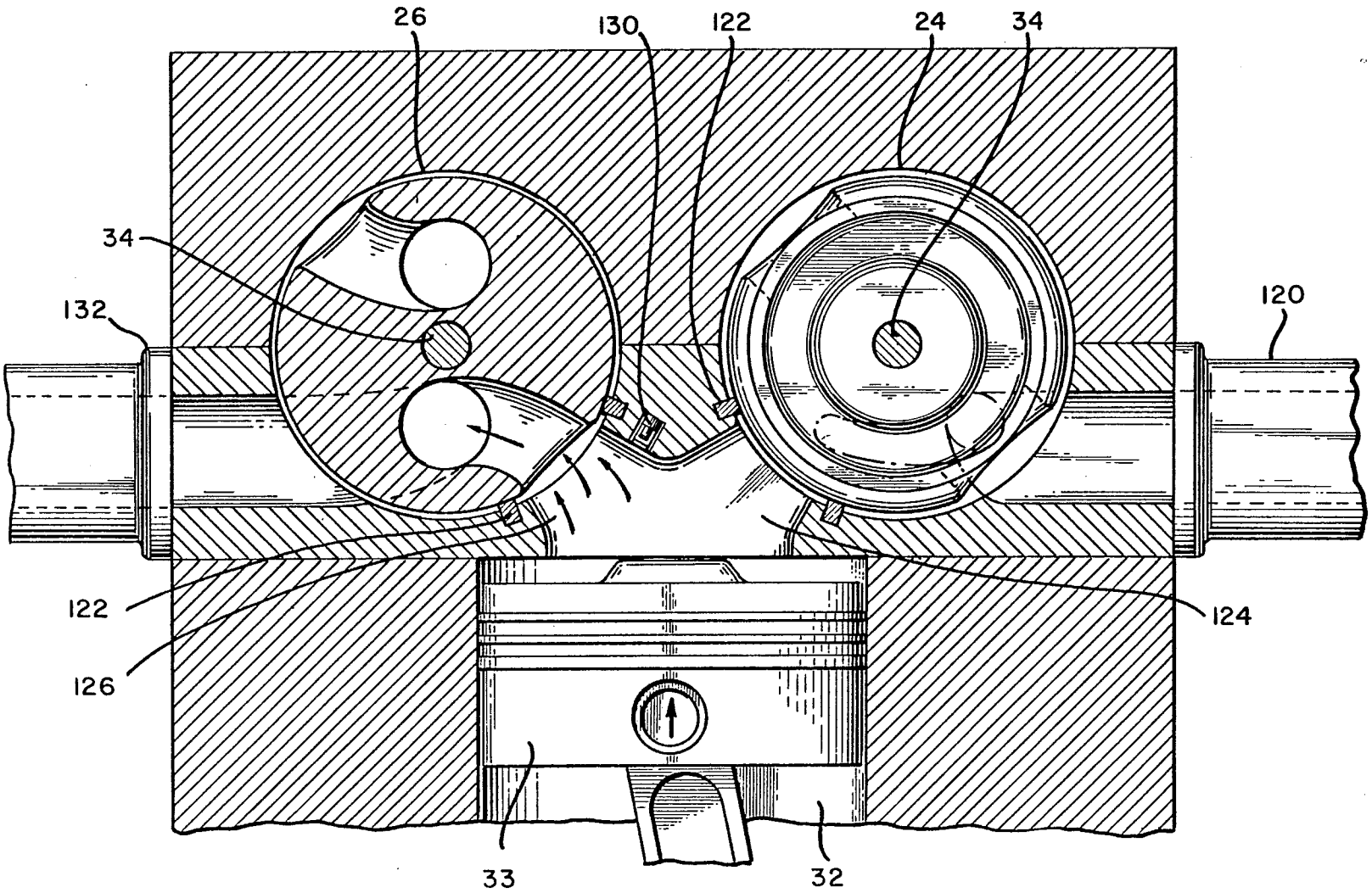
FIG. 14 is a cross sectional end view of the rotary valve assembly showing the relationship between the spherical intake valve and the spherical exhaust valve during the evacuation of spent gases.

FIG. 14 shows that intake spherical valve 24 still maintains inlet port 124 in a closed position, but exhaust spherical valve 26 has now moved such that peripheral aperture 90 is in registration with cylinder exhaust port 126 permitting the evacuation of the exhaust gases by means of exhaust conduit 88 to exhaust port 132. Upon the complete evaluation of the gases, exhaust conduit 88 would move out of registration with exhaust port 126 and the second inlet port 70 on the periphery 60 of intake spherical valve 24 would move into registration with inlet port 124 for the reintroduction of the fuel/air mixture.

In this configuration, the intake spherical valve 24 and exhaust spherical valve 26 would move at one-quarter of the speed of the crankshaft as a result of having two inlet apertures and two exhaust conduits contained within each valve respectively. The gearing for such a quarter speed mechanism is as disclosed in FIG. 12.

The ability to operate the engine with the valve assembly operating at one-quarter speed allows for less wear on the valve mechanism, cooler operating temperatures, and less maintenance problems.

The intake spherical valve 24 and exhaust spherical valves 26 rotate with shaft 34, shaft 34 being supported by bearing means 36. The bearing means are lubricated by the drip feed system previously described. Intake spherical valves 24 and exhaust spherical valves 26 within drum accommodating cavities 22 contact sealing rings 122, sealing rings 122 being annularly positioned about the cylinder inlet port and inlet cylinder exhaust port. Sealing rings 122 have an arcuate surface which conforms to the peripheral surface 60 and 80, respectively of intake spherical valve 24 and exhaust spherical valve 26. Sealing rings 122 as described in the prior identified applications by applicant, provide a seal with the respective valves during the compression or power stroke.

In the configuration as disclosed herein, Applicant has achieved a one-quarter speed valve mechanism in relationship to the rotation of the crankshaft by utilizing two intake conduits on each of the rotary exhaust valve and rotary intake valve and by establishing the rotary intake valve and the rotary exhaust valve on separate shafts. One shaft would be driven by communication with the crankshaft. This shaft in turn, through an idler drive gear, would rotate the opposing shaft which in turn would rotate the first shaft from the opposing longitudinal end.

Applicant's rotary intake valve and rotary exhaust valve are in gas tight sealing contact with seals 122 in drum accommodating cavities. The lubrication required is that of the bearing surfaces which support the rotary intake valves, rotary exhaust valves and the shaft. These bearing surfaces are positioned adjacent to the rotary intake valve and rotary exhaust valve, respectively and are sealed at their ends. The lubrication for these bearing surfaces is by means of a drip feed system in which the oil from the sump passes down a longitudinal conduit within shaft 34 and directed by transverse conduits in shaft 34 to the needle bearings within the bearing means. Excess lubrication passes through the longitudinal conduit in shaft 34 and returns to the oil sump.

It will be recognized by those skilled in the art that depending upon engine size, increasing the dimensions of the rotary intake valve and the rotary exhaust valve would permit the utilization of additional conduits for the introduction of fuel/air mixture or the evacuation of the fuel/air mixture, thus permitting the valves to rotate at an even lesser speed relative to the crankshaft.

It will be recognized by those skilled in the art that the apparatus has been described in connection with the exemplary embodiments thereof and it will be understood that many modifications will be apparent to those of ordinary skill in the art and this application is intended to cover any adaptations or variations thereof. Therefore, it is manifestly intended that this invention be only limited by the claims and equivalents thereof.

I claim:

1. An improved rotary valve assembly for use in internal combustion engines of the piston and cylinder type, said spherical rotary valve assembly comprising:

a removable two-piece cylinder head securable to the internal combustion engine, said two-piece removable cylinder head comprising an upper and lower cylinder head section, said upper and lower cylinder head sections when secured to said internal combustion engine define two cavites radially aligned with the cylinders of said internal combustion engine, said cavities defining a plurality of first drum accommodating cavities for receipt of radially aligned rotary intake valves, said second cavity defining a plurality of second drum accommodating cavities for receipt of a plurality of radially aligned rotary exhaust valves, said lower cylinder head section and said plurality of first drum accommodating cavities having an inlet port in communication with said cylinder, said lower cylinder head section and said second drum accommodating cavities having an outlet port in communication with said cylinder;

a sealing means associated with said inlet and said outlet port;

a first passageway for the introduction of a fuel/ air mixture into said cylinder head by way of said first drum accommodating cavity and said rotary intake valve and a second passageway for the evacuation of exhaust gases from said cylinder by way of said second drum accommodating cavity and said rotary exhaust valve;

a first shaft means journaled on bearing surfaces within said first cavity radially aligned with said cylinders of said internal combustion engine, said first shaft means having mounted thereon, said rotary intake valves;

a second shaft means journaled on bearing surfaces within said second radially aligned cavity, said second shaft means having positioned thereon, a plurality of said rotary exhaust valves;

said rotary intake valve and said rotary exhaust valve each having a spherical section defined by two parallel planes of a sphere, said planes being disposed symmetrically about the center of said sphere, defining a spherical periphery and planer end walls, said rotary intake valves mounted on said first shaft means in said plurality of drum accommodating cavities in gas tight sealing contact with said inlet port, each of said rotary exhaust valves mounted on said second shaft means in said plurality of drum accommodating cavities in gas tight sealing contact with said inlet port and said outlet port, respectively, said rotary intake valve having a plurality of passageways therethrough for the introduction and interruption of fuel/air mixture to said engine and said rotary exhaust valve having a plurality of passageways therethrough for the evacuation and interruption of evacuation of said exhaust gases from said engine, wherein said shaft means and said rotary intake valve and rotary exhaust valve are rotated at a speed relative to said operating cycle of said engine relative to the number of passageways through said rotary intake valve and said rotary exhaust valves.

2. A spherical rotary valve assembly in accordance with claim 1 wherein said bearing surfaces supporting said first shaft means and said second shaft means comprise needle-bearing chambers positioned adjacent said rotary intake valves and said rotary exhaust valves, said needle-bearing chambers being sealed at their respective ends, said needle-bearings positioned within said chamber, in intimate contact with the outer circumference of said first shaft means and said second shaft means, said needle-bearings lubricated by means of lubricating oil introduced through a longitudinal conduit in said first and second shaft means, said shaft means having radial conduits positioned to coincide and communicate from said longitudinal conduit to said bearing surfaces.

3. A spherical rotary valve assembly in accordance with claim 1 wherein said first shaft means and said second shaft means and said rotary intake valves and respective rotary exhaust valves rotate at one-quarter speed of the crankshaft, said drive gear on said second shaft means in communication with a drive gear on said first shaft means for rotating said first shaft means, said first shaft means rotating said second shaft means from its opposing longitudinal end.

4. A spherical rotary valve assembly in accordance with claim 3 wherein an idler gear on said second shaft means is coupled to said crankshaft, said idler gear ratio 2:1 with said crankshaft, said idler gear coupled to a drive gear on said second shaft means, said coupling ratio 2:1, said drive gear on said second shaft means coupled to said drive gear on said first shaft means, said coupling ratio 1:2, said drive gear on said first shaft means having a second drive gear mounted at its opposite opposing longitudinal end, said opposite drive gear coupled to said second shaft means, said coupling ratio 1:1.

5. A spherical rotary valve assembly in accordance with claim 3 wherein an idler gear on said first shaft means is coupled to said crankshaft, said idler gear ratio 2:1 with said crankshaft, said idler gear coupled to a drive gear on said first shaft means, said coupling ratio 2:1, said drive gear on said first shaft means coupled to said drive gear on said second shaft means, said coupling ratio 1:2, said drive gear on said second shaft means having a first drive gear mounted at its opposite longitudinal end, said opposite drive gear coupled to said first shaft means, said coupling ratio 1:1.

6. A spherical rotary valve assembly in accordance with claim 1 wherein said rotary intake valve in said first drum accommodating cavity comprises a recessed doughnut cavity on one planer side in continuous contact with said first passageway for the introduction of said fuel/air mixture, said rotary intake valve having two apertures on its spherical periphery positioned 180° apart in communication with said recessed doughnut cavity for rotational successive alignment with said inlet port of said cylinder for the introduction of said fuel/air mixture, said rotary intake valve rotating at one-quarter speed of said crankshaft.

7. A spherical rotary valve assembly in accordance with claim 6 wherein said recessed doughnut cavity is U-shaped in cross section.

8. A spherical rotary valve assembly in accordance with claim 6 wherein said apertures in said periphery of said rotary intake valve are circular in cross section.

9. A spherical rotary valve assembly in accordance with claim 6 wherein said rotary intake valve has a shaft receiving aperture longitudinally formed on said center extending between said planer sidewalls.

10. A spherical rotary valve assembly in accordance with claim 6 wherein the intersecting edge about said apertures on said periphery is rounded with respect to said spherical shaped end wall.

11. A spherical rotary valve assembly in accordance with claim 6 wherein said planer sidewalls of said rotary intake valve are symmetrically disposed about said center of said drum body.

12. A spherical rotary valve assembly in accordance with claim 6 wherein said apertures on said spherically-shaped end walls of said rotary intake valve are centrally disposed.

13. A spherical rotary valve assembly in accordance with claim 6 wherein said rotary exhaust valve for use in said spherical rotary valve assembly comprises a drum body of spherical section formed by two parallel planer sidewalls of the sphere disposed about a center of said sphere thereby defining a spherically-sh--aped end wall; and formed with a shaft receiving aperture, said drum body formed with two conduits extending between apertures in said spherically-shaped end walls, said apertures disposed 180° apart, to respective apertures in one of said planer sidewalls.

14. A spherical rotary valve assembly in accordance with claim 13 wherein said aperture in said end wall of said rotary exhaust valve is circular in cross section.

15. A spherical rotary valve assembly in accordance with claim 13 wherein said shaft receiving aperture in said rotary exhaust valve is longitudinally formed on said center extending between said planer sidewalls.

16. A spherical rotary valve assembly in accordance with claim 13 wherein said intersecting edges about said apertures positioned on said spherically-shaped end walls are rounded.

17. A spherical rotary valve assembly in accordance with claim 13 wherein said planer sidewalls of said rotary exhaust valve are symmetrically disposed about center of said drum body.

18. A spherical rotary valve assembly in accordance with claim 13 wherein said apertures on said spherically-shaped end wall of said rotary exhaust valve are centrally disposed.

* * * * *